US012796727B2

(12) United States Patent
Sutton

(10) Patent No.: US 12,796,727 B2
(45) Date of Patent: Nov. 17, 2026

(54) CANNABIS CIGARETTE ROLLING DEVICE

(71) Applicant: Rashawn Sutton, Fresno, CA (US)

(72) Inventor: Rashawn Sutton, Fresno, CA (US)

( * ) Notice: Subject to any disclaimer, the term of this patent is extended or adjusted under 35 U.S.C. 154(b) by 331 days.

(21) Appl. No.: 18/732,177

(22) Filed: Jun. 3, 2024

(65) Prior Publication Data

US 2025/0366508 A1 Dec. 4, 2025

(51) Int. Cl.

| | |
|---|---|
| ***A24C 5/02*** | (2006.01) |
| ***A24B 7/06*** | (2006.01) |
| ***A24B 7/14*** | (2006.01) |
| ***A24C 5/00*** | (2020.01) |
| ***A24C 5/10*** | (2006.01) |
| ***A24C 5/39*** | (2006.01) |

(52) U.S. Cl.

CPC ..... *A24C 5/02* (2013.01); *A24B 7/06* (2013.01); *A24B 7/14* (2013.01); *A24C 5/002* (2013.01); *A24C 5/005* (2013.01); *A24C 5/10* (2013.01); *A24C 5/39* (2013.01)

(58) Field of Classification Search

CPC .. A24C 5/02; A24C 5/002; A24C 5/44; A24B 7/06; A24B 7/14

See application file for complete search history.

(56) References Cited

U.S. PATENT DOCUMENTS

| | | | | |
|---|---|---|---|---|
| 6,553,742 | B2 | 4/2003 | Spatafora | |
| 11,129,407 | B2 | 9/2021 | Loucks | |
| D964,642 | S | 9/2022 | Roehm | |
| 11,503,854 | B2 | 11/2022 | Veelo | |
| 2013/0228187 | A1 | 9/2013 | Yisha | |
| 2019/0297936 | A1* | 10/2019 | Kang | A24C 3/00 |
| 2020/0329756 | A1* | 10/2020 | Karim | A24C 5/465 |
| 2021/0219598 | A1 | 7/2021 | Ruzycky | |
| 2022/0202067 | A1 | 6/2022 | Kirk | |
| 2023/0042188 | A1* | 2/2023 | Rahamim | B02C 18/24 |

FOREIGN PATENT DOCUMENTS

| | | |
|---|---|---|
| WO | WO2021076877 | 4/2021 |

* cited by examiner

*Primary Examiner* — Katelyn W Smith
*Assistant Examiner* — Jennifer A Kessie

(57) ABSTRACT

A cannabis cigarette rolling device includes a housing that has a wrapper inlet and a cigar hole and a cannabis inlet. A slicing unit is positioned within the housing to receive the cigar and slice the cigar to remove a tobacco wrapper of the cigar. The wrapper inlet receives the tobacco wrapper from the slicing unit. A grinding unit is positioned within the housing to receive cannabis flower and grind the cannabis flower into a granular material. A roller unit is pivotally mounted in the housing to receive the tobacco rolling sheet or the tobacco wrapper of the cigar and the granular material. The roller unit rolls the tobacco rolling sheet or the tobacco wrapper of the cigar around the granular material to produce a cannabis cigarette commonly referred to as a blunt. The roller unit subsequently ejects the blunt from the housing for the smoking enjoyment of a user.

17 Claims, 10 Drawing Sheets

CANNABIS CIGARETTE ROLLING DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to rolling devices and more particularly pertains to a new rolling device for automatically rolling a cannabis cigarette commonly referred to as a blunt. The device includes a grinding unit and a roller unit and a slicing unit each positioned within a housing. The grinding unit receives cannabis flower that is inserted through a cannabis inlet in the housing to grind the cannabis flower into a granular material which is subsequently deposited into the roller unit. The slicing unit insertably receives a cigar and longitudinally slices the cigar to remove the tobacco wrapper from the cigar and the slicing unit transfers the tobacco wrapper into the roller unit. The roller unit subsequently rolls the tobacco wrapper around the granular material to roll a cannabis cigarette commonly referred to as a blunt.

(2) Description of Related Art Including Information Disclosed Under 37 CFR 1.97 and 1.98

The prior art relates to rolling devices including a variety of automated cigar rolling devices that each at least includes a housing and a mechanism for automatically rolling a cigar and a variety of automated cigarette rolling devices that each at least includes a housing and a mechanism for automatically rolling cigarettes and a variety of cigarette rolling devices that is each longitudinally elongated for inserting tobacco into cigarette tubes. In no instance does the prior art disclose a cannabis cigarette rolling device that includes a housing in which a grinding unit is positioned for grinding cannabis flower and a slicing unit for longitudinally slicing a cigar to remove the tobacco wrapper from the cigar and a roller unit which receives the granular material and the tobacco wrapper to automatically roll a cannabis cigarette commonly referred to as a blunt.

(h) BRIEF SUMMARY OF THE INVENTION

An embodiment of the disclosure meets the needs presented above by generally comprising a housing that has a wrapper inlet and a cigar hole and a cannabis inlet. A slicing unit is positioned within the housing to receive the cigar and slice the cigar to remove a tobacco wrapper of the cigar. The wrapper inlet receives the tobacco wrapper from the slicing unit. A grinding unit is positioned within the housing to receive cannabis flower and grind the cannabis flower into a granular material. A roller unit is pivotally mounted in the housing to receive the tobacco rolling sheet or the tobacco wrapper of the cigar and the granular material. The roller unit rolls the tobacco rolling sheet or the tobacco wrapper of the cigar around the granular material to produce a cannabis cigarette commonly referred to as a blunt. The roller unit subsequently ejects the blunt from the housing for the smoking enjoyment of a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
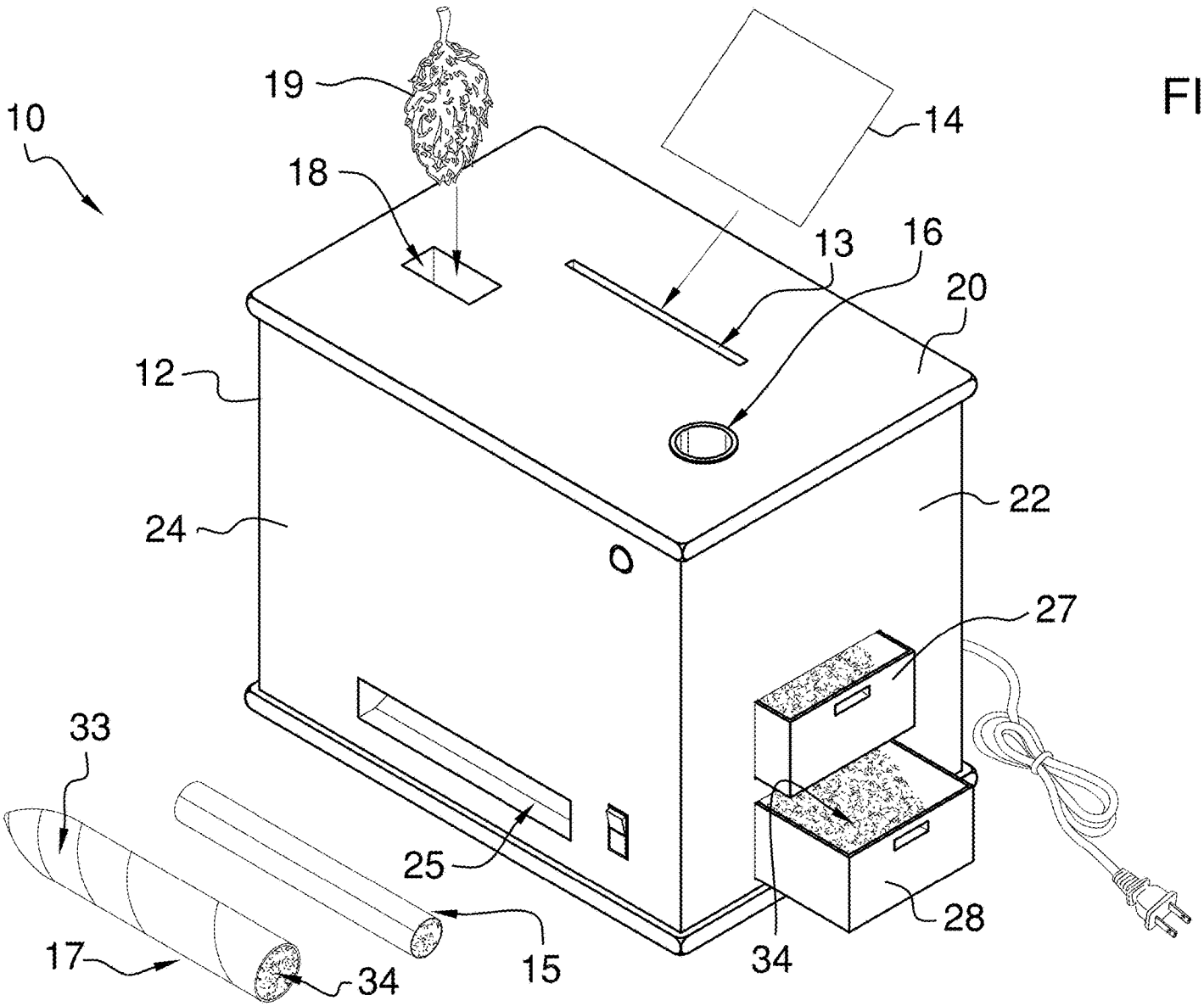
FIG. 1 is a top perspective phantom view of a cannabis cigarette rolling device according to an embodiment of the disclosure.
Figure 2:
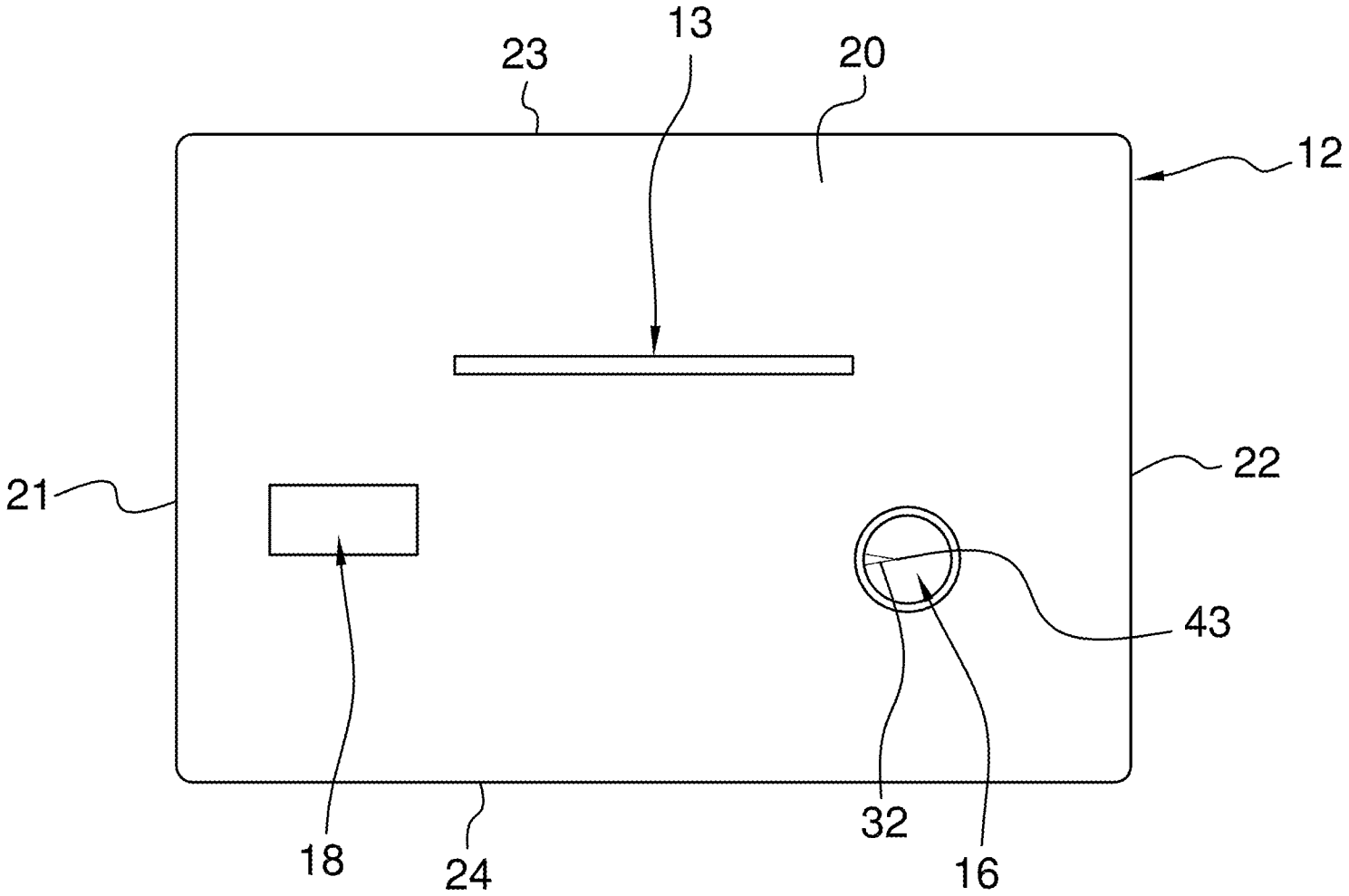
FIG. 2 is a top view of an embodiment of the disclosure.
Figure 3:
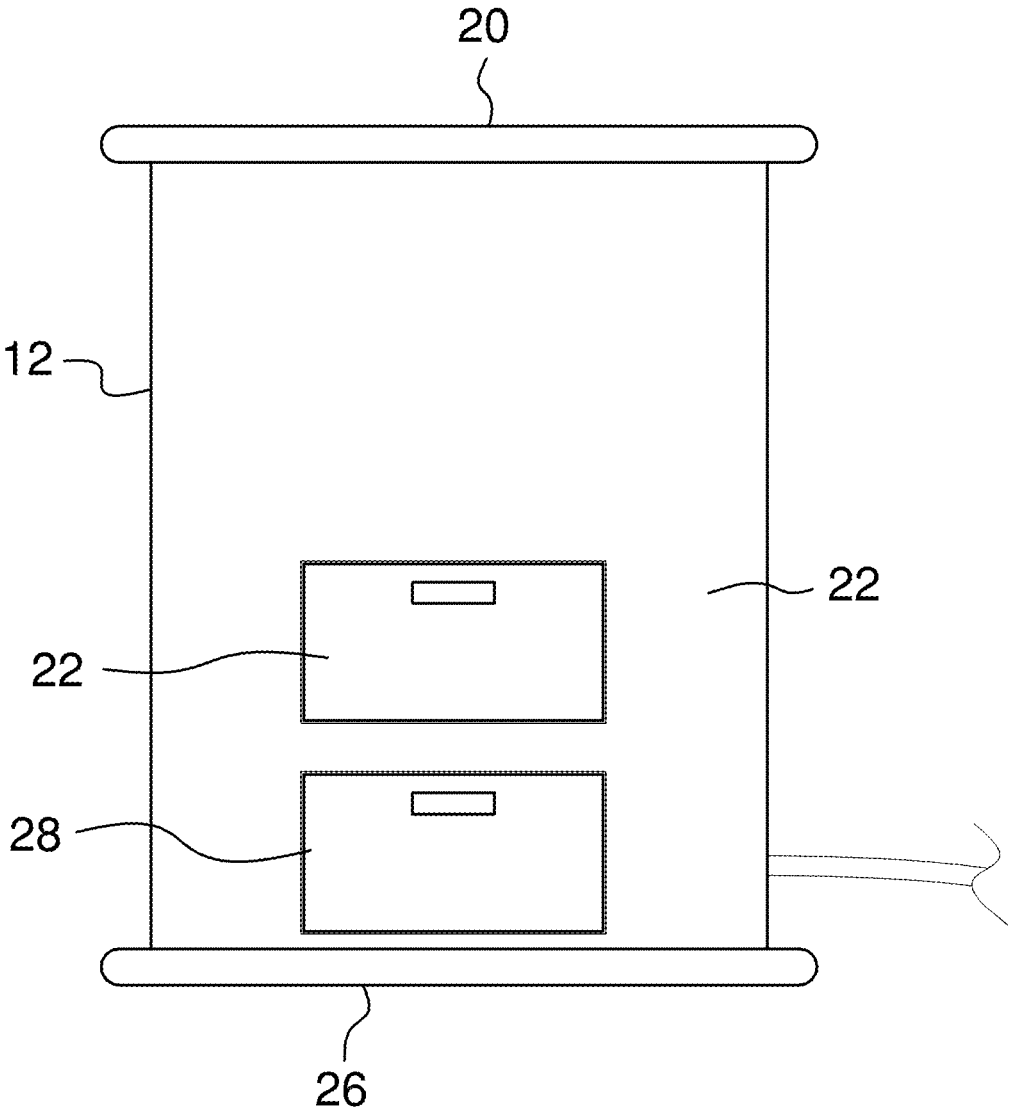
FIG. 3 is a left side view of an embodiment of the disclosure.
Figure 4:
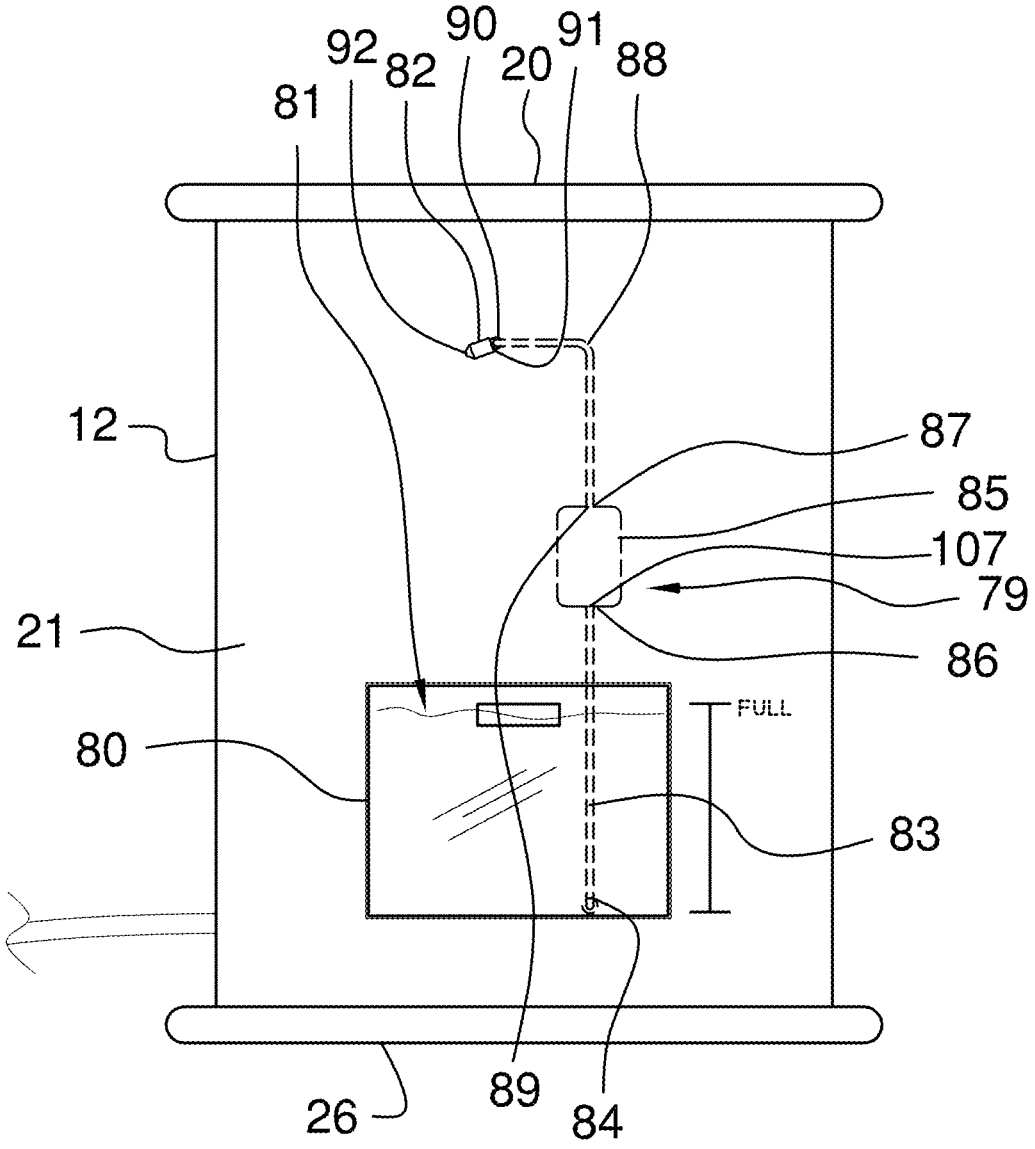
FIG. 4 is a right side phantom view of an embodiment of the disclosure.
Figure 5:
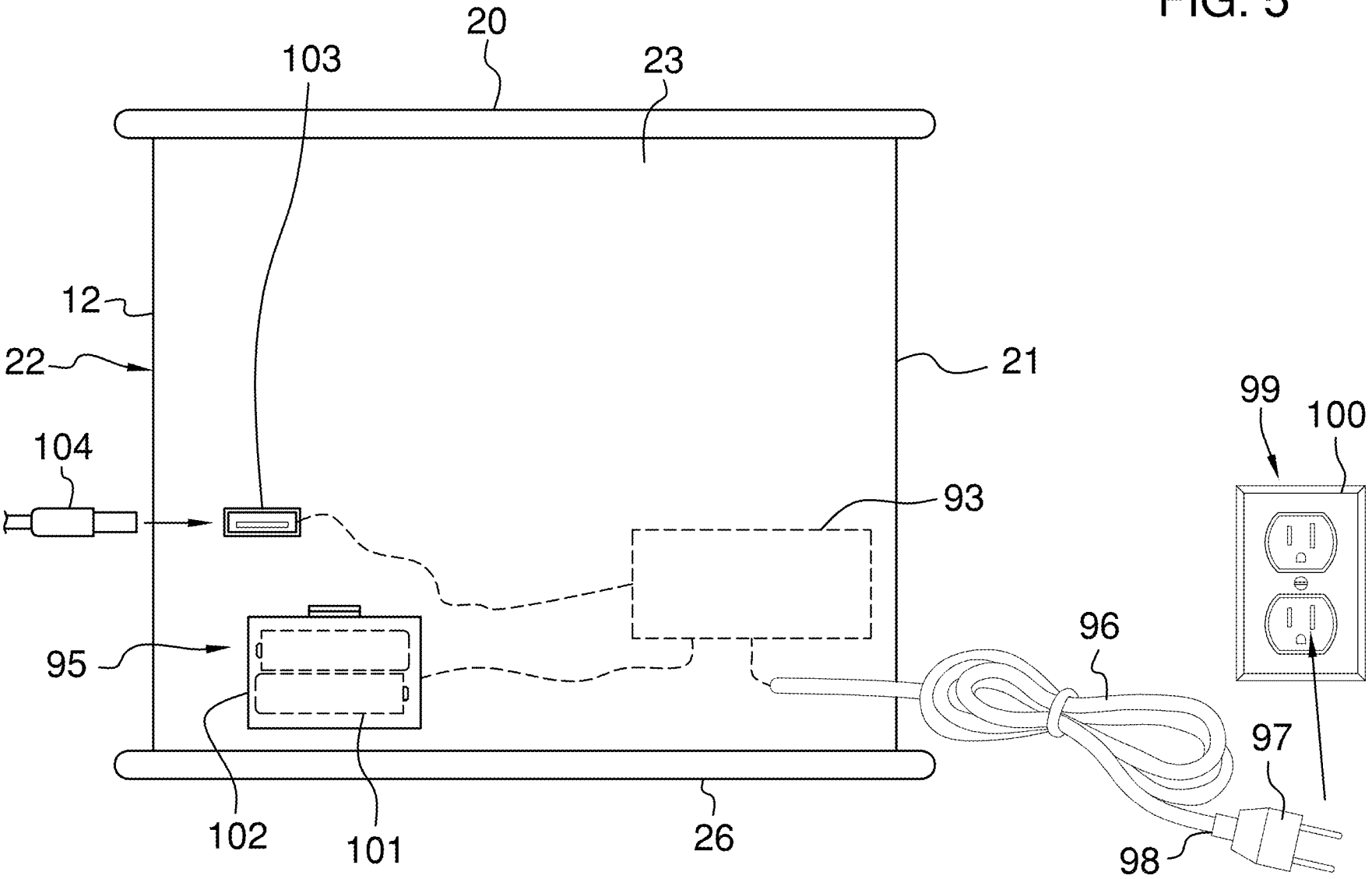
FIG. 5 is a back phantom view of an embodiment of the disclosure.
Figure 6:
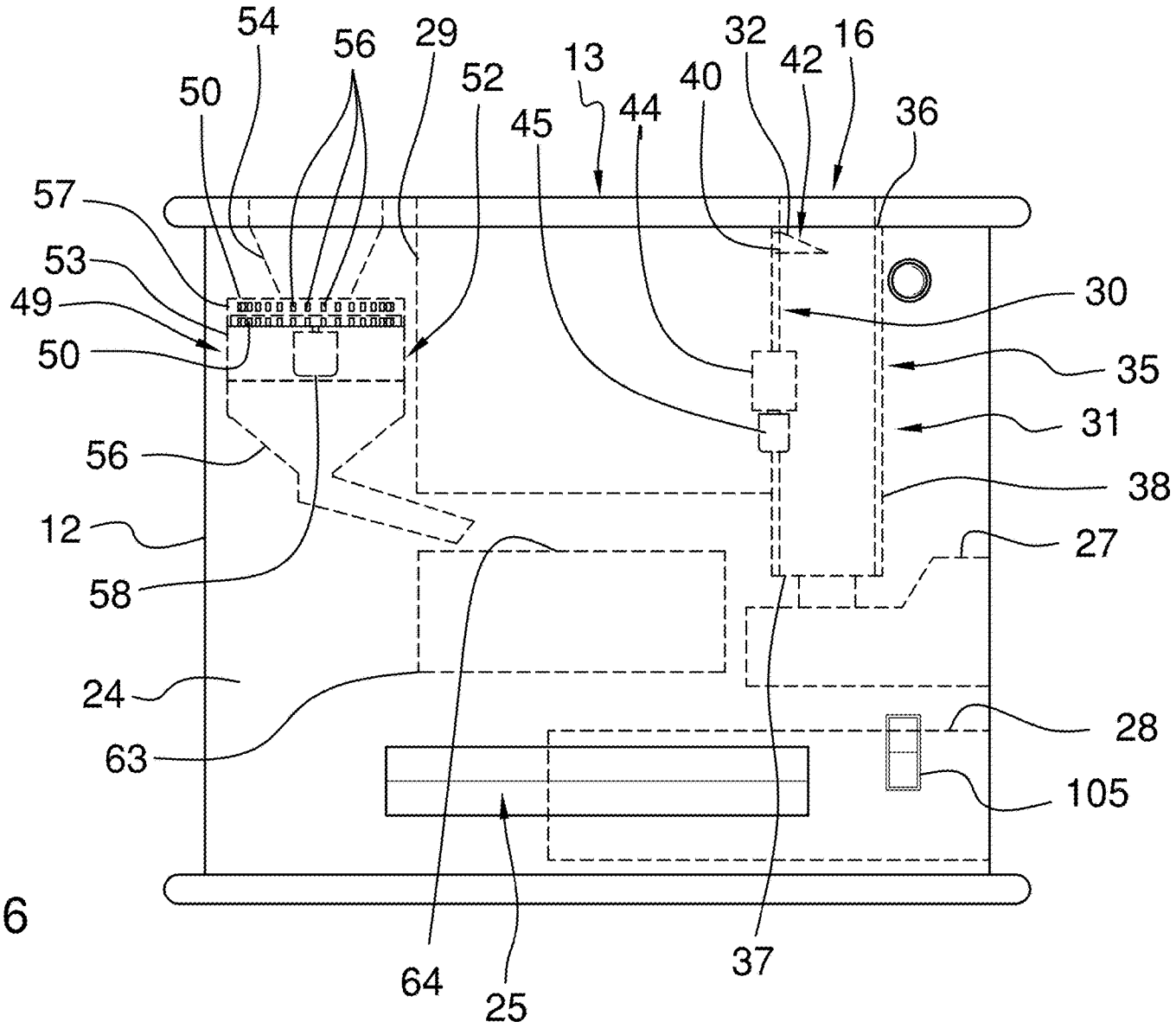
FIG. 6 is a front phantom view of an embodiment of the disclosure.
Figure 7:
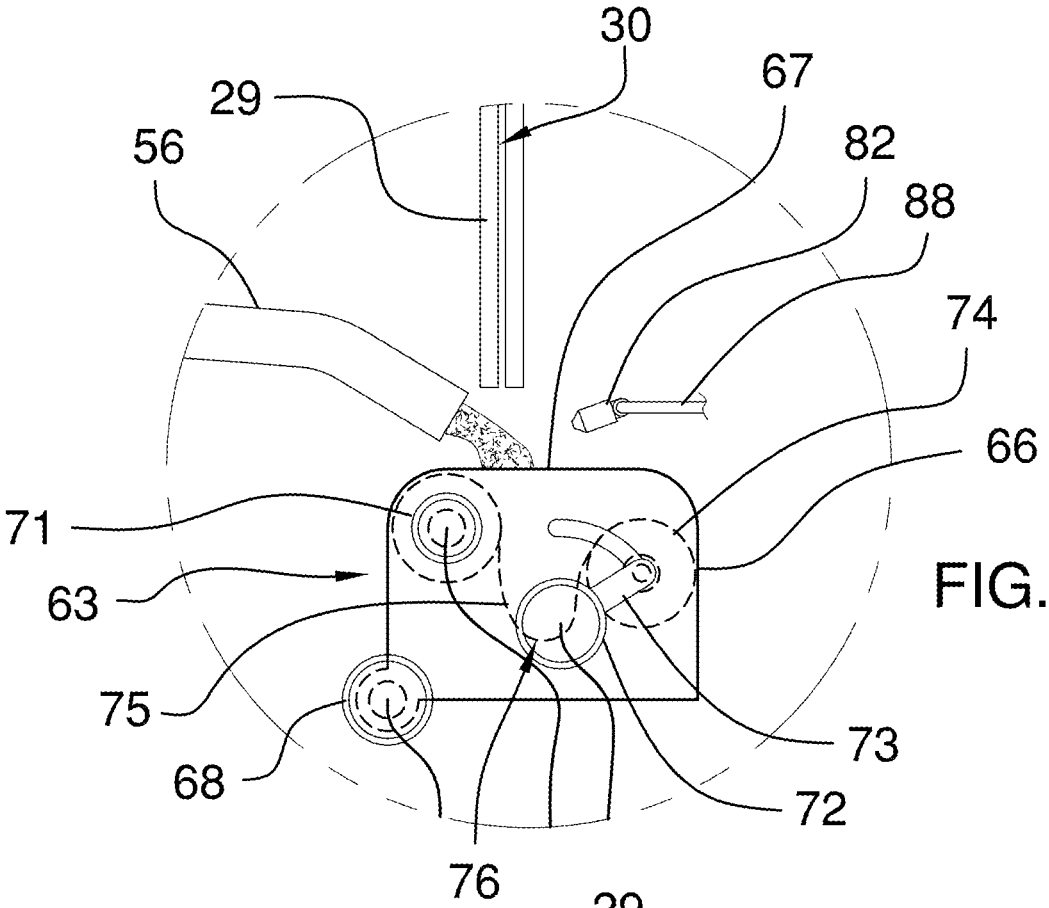
FIG. 7 is a magnified detail view of a roller unit taken from circle 7 of FIG. 6 of an embodiment of the disclosure showing the roller unit receiving a granular material.
Figure 8:
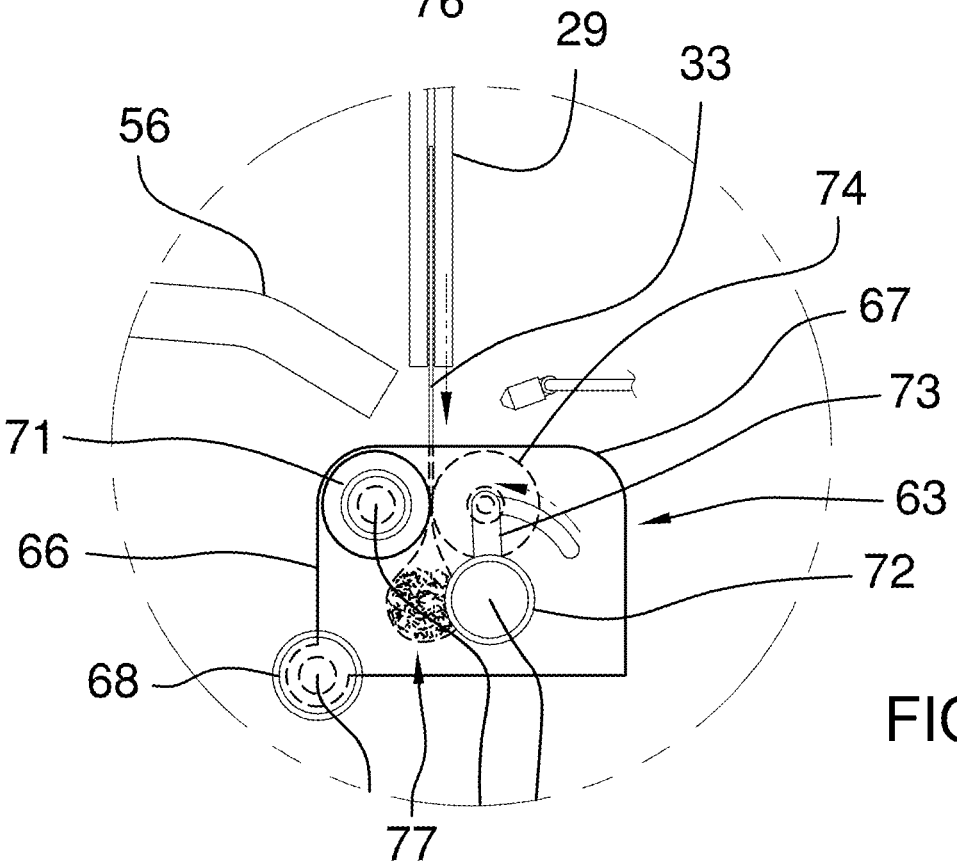
FIG. 8 is a magnified detail view of a roller unit taken from circle 7 of FIG. 6 of an embodiment of the disclosure showing the roller unit receiving a tobacco wrapper of a cigar.
Figure 9:
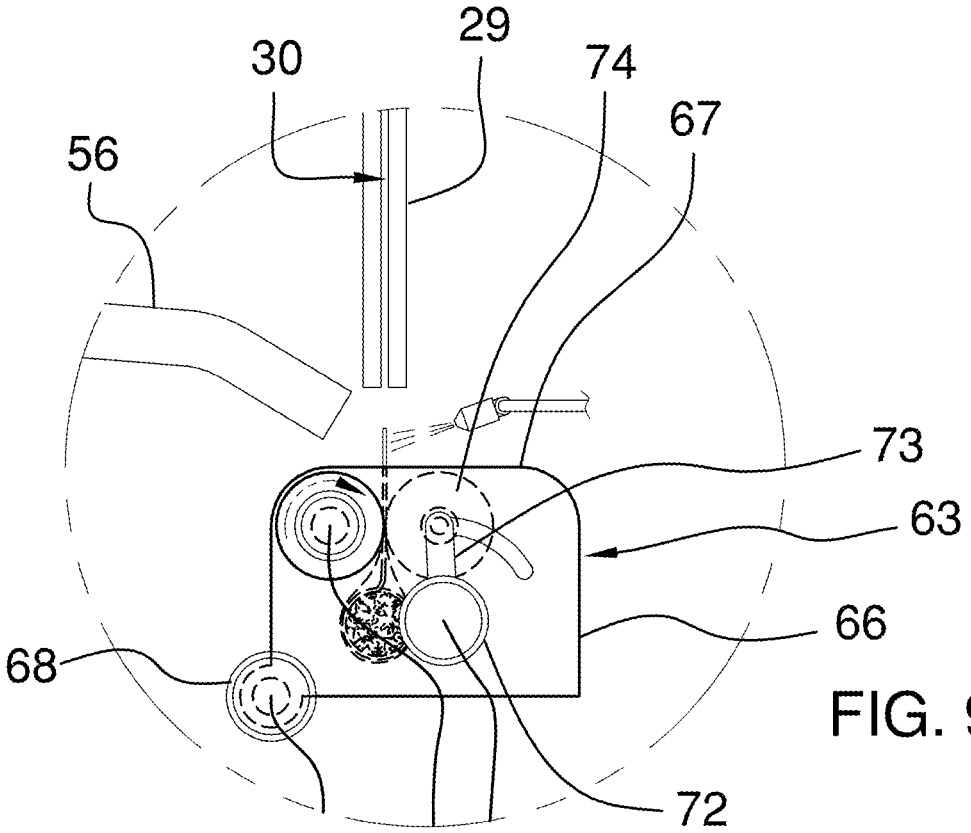
FIG. 9 is a magnified detail view of a roller unit taken from circle 7 of FIG. 6 of an embodiment of the disclosure showing the roller unit rolling a tobacco wrapper of a cigar around granular material to form a cannabis cigarette commonly referred to as a blunt.
Figure 10:
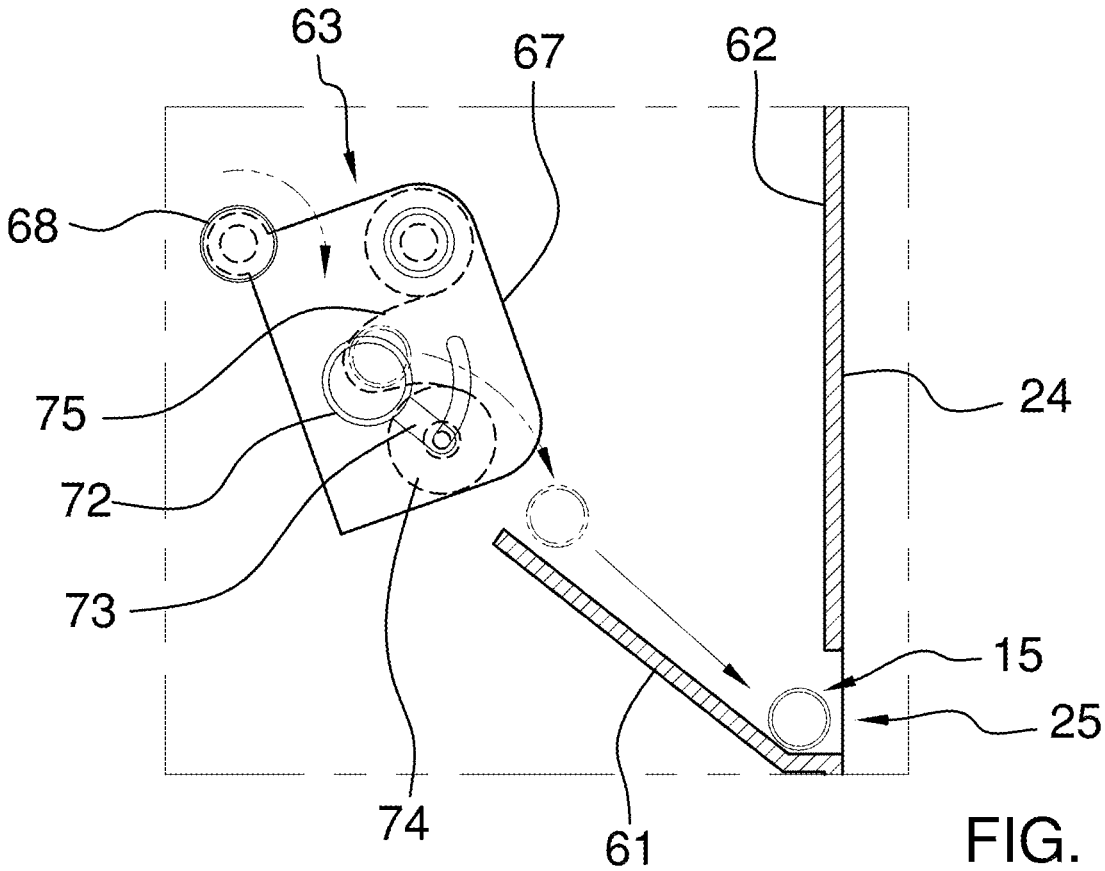
FIG. 10 is a magnified detail view of a roller unit taken from circle 7 of FIG. 6 of an embodiment of the disclosure showing the roller unit ejecting a cannabis cigarette commonly referred to as a blunt.
Figure 11:
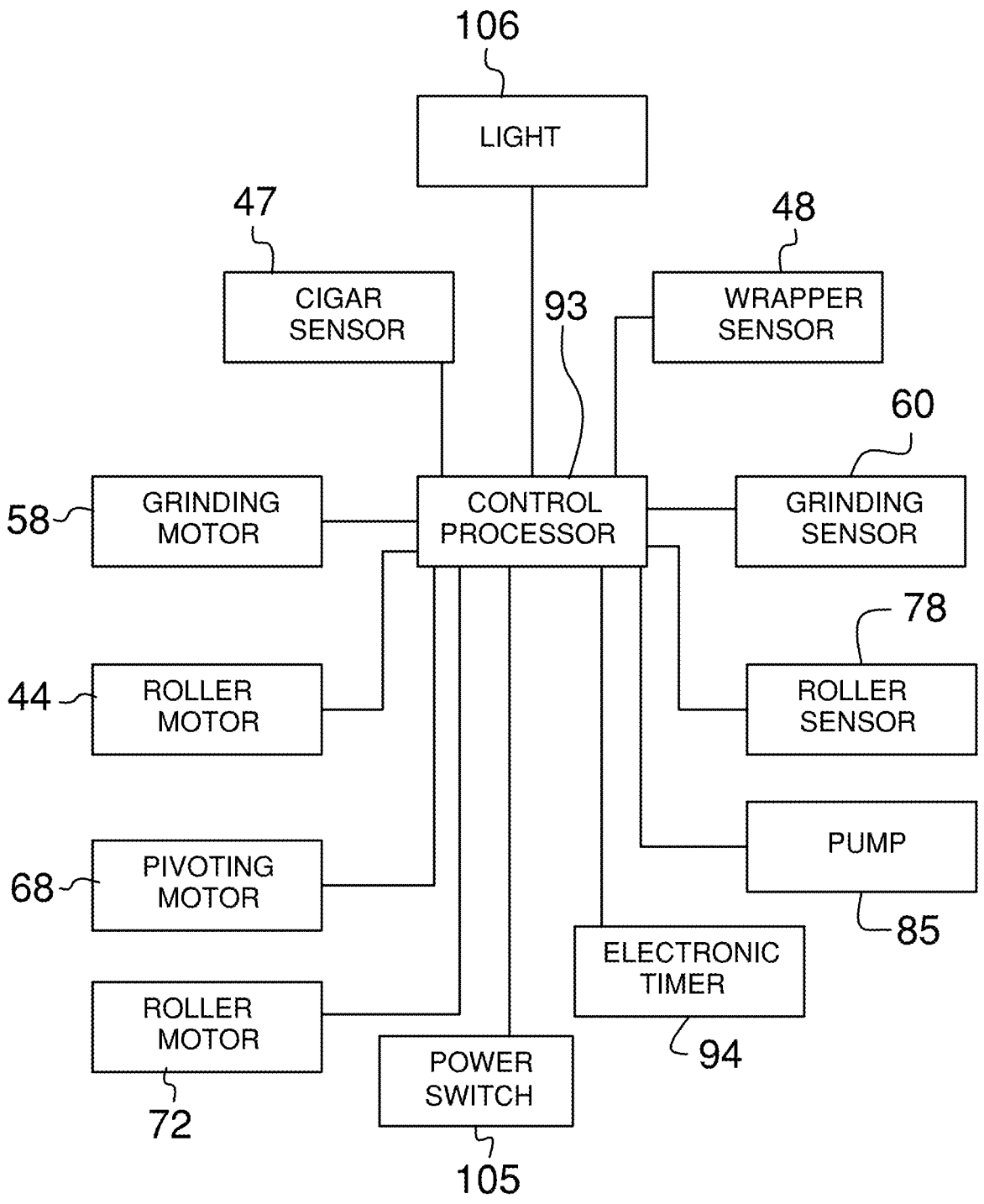
FIG. 11 is a schematic view of an embodiment of the disclosure.
Figure 12:
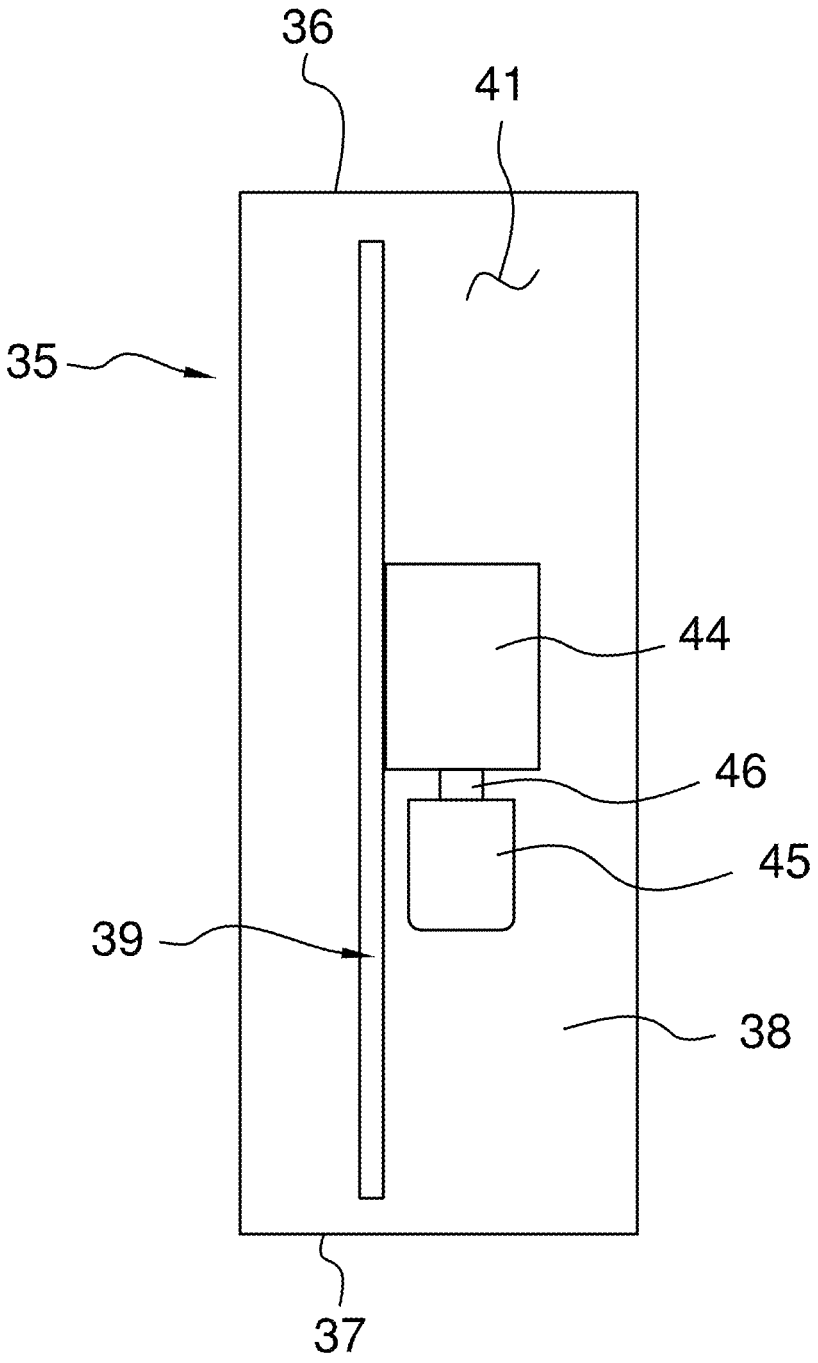
FIG. 12 is a right side view of a slicing cylinder of an embodiment of the disclosure.

With reference now to the drawings, and in particular to FIGS. 1 through 12 thereof, a new rolling device embodying the principles and concepts of an embodiment of the disclosure and generally designated by the reference numeral 10 will be described.

As best illustrated in FIGS. 1 through 12, the cannabis cigarette rolling device 10 generally comprises a housing 12 that has a wrapper inlet 13 extending into an interior of the housing 12 to insertably receive a tobacco rolling sheet 14. The tobacco rolling sheet 14 may be a tobacco rolling sheet that is commonly employed for rolling a cannabis cigarette commonly referred to as a blunt 15. The housing 12 has a cigar hole 16 extending into the interior of the housing 12 to insertably receive a cigar 17 and the housing 12 has a cannabis inlet 18 extending into the interior of the housing 12 to insertably receive cannabis flower 19. The wrapper inlet 13 extends through a top wall 20 of the housing 12 and the wrapper inlet 13 is elongated along a line extending between a first lateral wall 21 and a second lateral wall 22 of the housing 12. Furthermore, the wrapper inlet 13 is positioned closer to a back wall 23 of the housing 12 than a front wall 24 of the housing 12.

The cigar hole 16 extends through the top wall 20 of the housing 12 and the cigar hole 16 is positioned closer to the second lateral wall 22 of the housing 12 than the first lateral wall 21 of the housing 12. Additionally, the cigar hole 16 is positioned between the wrapper inlet 13 and the front wall 24 of the housing 12. The cannabis inlet 18 extends through the top wall 20 of the housing 12 and the cannabis inlet 18 is positioned closer to the first lateral wall 21 of the housing 12 than the second lateral wall 22 of the housing 12. Furthermore, the cannabis inlet 18 is positioned between the wrapper inlet 13 and the front wall 24 of the housing 12.

The housing 12 has an output opening 25 extending through the front wall 24 of the housing 12 into the interior of the housing 12 and the output opening 25 is elongated to extend substantially between the first lateral wall 21 and the second lateral wall 22 of the housing 12. The output opening 25 is positioned closer to a bottom wall 26 of the housing 12 than the top wall 20 of the housing 12. Additionally, the output opening 25 is centrally positioned between the first lateral wall 21 and the second lateral wall 22. The housing 12 has a tobacco drawer 27 that is slidably integrated into the second lateral wall 22 of the housing 12 and the housing 12 has a cannabis drawer 28 that is slidably integrated into the second lateral wall 22 of the housing 12. The tobacco drawer 27 is centrally positioned between the top wall 20 and the bottom wall 26 of the housing 12 and the cannabis drawer 28 is positioned between the tobacco drawer 27 and the bottom wall 26.

The wrapper inlet 13 includes a wrapper chute 29 which is coupled to and extends downwardly from the top wall 20 of the housing 12 such that the wrapper chute 29 extends into the interior of the housing 12. In this way the wrapper chute 29 can insertably receive the tobacco rolling sheet 14 when the tobacco rolling sheet 14 is inserted through the wrapper inlet 13. Additionally, the wrapper chute 29 has an entry 30 which extends laterally through the wrapper chute 29.

A slicing unit 31 is positioned within the housing 12 and the slicing unit 31 is aligned with the cigar hole 16 to receive the cigar 17 when the cigar 17 is inserted into the cigar hole 16. The slicing unit 31 includes a blade 32 which is aligned with the cigar hole 16 slice the cigar 17 when the cigar 17 is urged downwardly into the cigar hole 16. In this way the blade 32 enables a tobacco wrapper of the cigar 33 to be removed from the cigar 17 and enables ground tobacco 34 in the cigar 17 to be removed from the cigar 17. Furthermore, the slicing unit 31 is in communication with the wrapper inlet 13 to enable the wrapper inlet 13 to receive the tobacco wrapper 33 from the slicing unit 31.

The slicing unit 31 comprises a slicing cylinder 35 which is positioned within the housing 12. The slicing cylinder 35 has an upper end 36 and a lower end 37 and an outer wall 38 extending between the upper end 36 and the lower end 37 and the slicing cylinder 35 has a wrapper slot 39 extending through the outer wall 38. The wrapper slot 39 is elongated to extend substantially between the upper end 36 and the lower end 37 and the wrapper slot 39 is aligned with and is directed toward the entry 30 in the wrapper chute 29. Each of the upper end 36 and the lower end 37 is open and the upper end 36 is aligned with the cigar hole 16 having the slicing cylinder 35 being vertically oriented in the housing 12. In this way the upper end 36 can insertably receive the cigar 17 when the cigar 17 is inserted into the cigar hole 16.

The blade 32 has a coupled end 40 that is attached to an inside surface 41 of the outer wall 38 of the slicing cylinder 35 such that the blade 32 extends into an interior of the slicing cylinder 35. The blade 32 is positioned adjacent to the upper end 36 of the slicing cylinder 35 and the blade 32 has a cutting edge 42 angling downwardly between the coupled end 40 and a free end 43 of the blade 32 such that the blade 32 tapers to a point at the free end 43. The cutting edge 42 is sharpened to enable the cutting edge 42 to cut through the tobacco wrapper of the cigar 33 when the cigar 17 is urged downwardly through the cigar hole 16. The lower end 37 of the slicing cylinder 35 is aligned with the tobacco drawer 27 to direct the ground tobacco 34 in the cigar 17 downwardly into the tobacco drawer 27 when the cigar 17 is sliced thereby enabling the ground tobacco 34 to be collected in the tobacco drawer 27.

The slicing unit 31 includes a wrapper roller 44 which is rotatably disposed in the outer wall 38 of the slicing cylinder 35 and the wrapper roller 44 frictionally engages the tobacco wrapper 33 when the cigar 17 is sliced. Additionally, the wrapper roller 44 is rotatable about an axis extending between the upper end 36 and the lower end 37 of the slicing cylinder 35. The wrapper roller 44 is aligned with the wrapper slot 39 in the outer wall 38 of the slicing cylinder 35 to urge the tobacco wrapper 33 outwardly through the wrapper slot 39 and inwardly through the entry 30 in the wrapper chute 29.

The slicing unit 31 includes a wrapper motor 45 that is disposed in the outer wall 38 of the slicing cylinder 35 and the wrapper motor 45 has an output shaft 46 that is in mechanical communication with the wrapper roller 44. The wrapper motor 45 rotates the output shaft 46 in a first direction when the wrapper motor 45 is turned on thereby facilitating the output shaft 46 to rotate the wrapper roller 44 about the axis extending between the upper end 36 and the lower end 37 of the slicing cylinder 35. Additionally, the wrapper motor 45 may comprise an electric motor or the like. The slicing unit 31 includes a cigar sensor 47 that is positioned in the slicing cylinder 35 to sense when the cigar 17 is urged into the slicing cylinder 35. The cigar sensor 47 may be an optical sensor or a pressure switch or other type of electronic sensor that is capable of sensing when the presence of the cigar 17 in the slicing cylinder 35. Additionally, a wrapper sensor 48 is positioned in the wrapper chute 29 to sense either the tobacco rolling sheet 14 or the tobacco wrapper of the cigar 33 in the wrapper chute 29. The wrapper sensor 48 may comprise an optical sensor or a pressure switch or other type of electronic sensor that is capable of sensing the presence of the tobacco rolling sheet 14 or the tobacco wrapper of the cigar 33 in the wrapper chute 29.

A grinding unit 49 is positioned within the housing 12 and the grinding unit 49 is aligned with the cannabis inlet 18 to receive the cannabis flower 19 that is inserted into the cannabis inlet 18. The grinding unit 49 has a pair of rotating grinding disks 50 which each rotate in opposing directions with respect to each other when the grinding unit 49 is turned on. In this way the grinding unit 49 is enabled to grind the cannabis flower 19 into a granular material 51. The grinding unit 49 includes a grinding hopper 52 which has a central container 53 that is positioned between and is in fluid communication with each of an entry funnel 54 and an exit funnel 55. The entry funnel 54 is in fluid communication with the cannabis inlet 18 to direct the cannabis flower 19 into the central container 53 when the cannabis flower 19 is inserted into the cannabis inlet 18. Additionally, the cannabis drawer 28 extends beneath the grinding unit 49 to capture excess granular material 51 that is produced by the grinding unit 49.

Each of the pair of rotating grinding disks 50 is rotatably disposed within the central container 53 and each of the pair of rotating grinding disks 50 is rotatable about an axis extending between the entry funnel 54 and the exit funnel 55. The pair of rotating grinding disks 50 is positioned closer to the entry funnel 54 than the exit funnel 55 and the pair of rotating grinding disks 50 directs the granular material 51 produced from the cannabis flower 19 downwardly into the exit funnel 55. Furthermore, the exit funnel 55 angles laterally away from the central container 53. Each of the pair of rotating grinding disks 50 has a series of teeth 56 disposed on an outer surface 57 of a respective rotating grinding disk 50 to chop the cannabis flower 19 into the granular material 51.

The grinding unit 49 includes a grinding motor 58 that is positioned within the central container 53 and the grinding motor 58 has an output shaft 59 that is in mechanical communication with each of the pair of rotating grinding disks 50. The grinding motor 58 rotates the output shaft 59 of the grinding motor 58 in a first direction when the grinding motor 58 is turned on thereby enabling the output shaft 59 of the grinding motor 58 to rotate each of the pair of rotating grinding disks 50. The grinding motor 58 may comprise an electric motor or the like. The grinding unit 49 includes a grinding sensor 60 that is positioned in the entry funnel 54 to sense the cannabis flower 19 entering the entry funnel 54. Furthermore, the grinding sensor 60 may comprise an optical sensor or a pressure switch or other type of electronic sensor that can sense the presence of the cannabis flower 19 in the entry funnel 54.

A dispensing ramp 61 is attached to and angles upwardly from an inside surface 62 the front wall 24 of the housing 12 such that the dispensing ramp 61 is positioned inside of the housing 12. Additionally, the dispensing ramp 61 is aligned with the output opening 25 in the front wall 24 of the housing 12. A roller unit 63 is pivotally mounted in the housing 12 and the roller unit 63 is positioned beneath the wrapper inlet 13 to receive the tobacco rolling sheet 14 when the tobacco rolling sheet 14 is inserted into the wrapper inlet 13 or the tobacco wrapper of the cigar 33 when the cigar 17 is inserted into the slicing unit 31. Additionally, the roller unit 63 is positioned adjacent to the grinding unit 49 to enable the roller unit 63 to receive the granular material 51 produced from the cannabis flower 19 by the grinding unit 49.

The roller unit 63 is pivoted into a first position having an input 64 of the roller unit 63 being directed toward the wrapper inlet 13 and the grinding unit 49. The roller unit 63 is actuated into a rolling condition when the roller unit 63 is in the first position to enable the roller unit 63 to roll either the tobacco rolling sheet 14 or the tobacco wrapper of the cigar 33 around the granular material 51. In this way the roller unit 63 is enabled to produce the cannabis cigarette commonly referred to as a blunt 15. Furthermore, the roller unit 63 is pivoted into a second position when the roller unit 63 is actuated into the rolling condition having the roller unit 63 being angled downwardly thereby facilitating the roller unit 63 to be in communication with the output opening 25 in the front wall 24 of the housing 12. In this way the roller unit 63 is enabled to deposit the cannabis cigarette commonly referred to as a blunt 15 into the output opening 25 thereby enabling a user 65 to retrieve the cannabis cigarette commonly referred to as a blunt 15 for smoking.

The roller unit 63 comprises a roller housing 66 has a top end 67 which is open and the top end 67 defines the input 64 of the roller unit 63. The roller unit 63 includes a pivoting motor 68 that is integrated into the roller housing 66 at a point aligned with an intersection between a rear wall 69 of the roller housing 66 and a lower wall 70 of the roller housing 66. The pivoting motor 68 pivots the roller housing 66 into a first position when the pivoting motor 68 is actuated to rotate in a first direction having the top end 67 of the roller housing 66 being directed toward the wrapper chute 29. In this way the top end 67 of the roller housing 66 is enabled to insertably receive either the tobacco rolling sheet 14 or the tobacco wrapper of the cigar 33. The pivoting motor 68 pivots the roller housing 66 into a second position when the pivoting motor 68 is actuated to rotate in a second direction having the roller housing 66 angling downwardly toward the dispensing ramp 61. The pivoting motor 68 may comprise a two direction electric motor or the like.

The roller unit 63 includes a first roller 71 that is rotatably disposed in the roller housing 66 and the first roller 71 is rotatable about an axis which is oriented parallel to the top end 67 of the roller housing 66. The first roller 71 is aligned with an intersection between the top end 67 of the roller housing 66 and the rear wall 69 of the roller housing 66. The roller unit 63 includes a roller motor 72 which is disposed within the roller housing 66 and the roller motor 72 rotates in a first direction or a second direction when the roller motor 72 is turned on. The roller motor 72 may comprise a two direction electric motor or the like.

The roller unit 63 includes a roller drive 73 that is mechanically coupled to the roller motor 72 and the roller drive 73 is driven in a first direction when the roller motor 72 rotates in the first direction. Conversely, the roller drive 73 is driven in a second direction when the roller motor 72 rotates in the second direction. The roller drive 73 is pivoted to travel toward the first roller 71 when the roller motor 72 rotates in the first direction and the roller drive 73 is pivoted to travel away from the first roller 71 when the roller motor 72 rotates in the second direction. The roller drive 73 may comprise a series of gears or a pair of pulleys and a belt or other type of mechanical drive that is capable of transmitting rotational torque produced by the roller motor 72.

The roller unit 63 includes a second roller 74 that is rotatably attached to the roller drive 73. The second roller 74 is rotated in a first direction when the roller motor 72 rotates in the first direction and the second roller 74 is rotated in a second direction when the roller motor 72 rotates in the second direction. Furthermore, the second roller 74 abuts the first roller 71 when the roller drive 73 is pivoted to travel toward the first roller 71 thereby enabling the second roller 74 to rotate the first roller 71 when the roller motor 72 rotates in the first direction. Conversely, the second roller 74 is displaced from the first roller 71 when the roller drive 73 is pivoted to travel away from the first roller 71.

The roller unit 63 includes a belt 75 which extends around each of the first roller 71 and the second roller 74 and the belt 75 travels in a first direction when the second roller 74 abuts and rotates the first roller 71. Additionally, as is most clearly shown in FIGS. 7 and 10, the belt 75 has a length that is sufficient to enable to the belt 75 to form an open loop 76 extending downwardly from the first roller 71 and the second roller 74 when the second roller 74 is displaced from the first roller 71. In this way the open loop 76 is configured to capture the granular material 51 produced by the grinding unit 49. As is most clearly shown in FIGS. 8 and 9, the belt 75 forms a closed loop 77 when the second roller 74 abuts the first roller 71. In this way the belt 75 is enabled to urge either the tobacco rolling sheet 14 or the tobacco wrapper 33 to wrap around the granular material 51 thereby forming the cannabis cigarette commonly referred to as a blunt 15 when the belt 75 is urged to travel in the first direction. The roller unit 63 includes a roller sensor 78 which is positioned in the roller housing 66 to sense the granular material 51 produced by the grinding unit 49 entering the top end 67 of the roller housing 66. The roller sensor 78 may comprise an optical sensor or a pressure switch or other type of electronic sensor that is capable of sensing the presence of the granular material 51 passing through the top end 67 of the roller housing 66.

A spraying unit 79 is positioned in the housing 12 and the spraying unit 79 includes a reservoir 80 which can contain water 81. The spraying unit 79 has a spray nozzle 82 that is directed toward the roller unit 63 and the spray nozzle 82 is in fluid communication with the reservoir 80. In this way the spray nozzle 82 is enabled to spray the water 81 onto either the tobacco rolling sheet 14 or the tobacco wrapper of the cigar 33 when the tobacco rolling sheet 14 or the tobacco wrapper of the cigar 33 enters the roller unit 63. In this way the tobacco rolling sheet 14 or the tobacco wrapper of the cigar 33 can be adhered to itself when the tobacco rolling sheet 14 or the tobacco wrapper of the cigar 33 is rolled around the granular material 51 produced by the grinding unit 49 to form the cannabis cigarette commonly referred to as a blunt 15.

The spraying unit 79 includes an intake tube 83 which extends into the reservoir 80 such that a bottom end 84 of the intake tube 83 is positioned within the reservoir 80. In this way the bottom end 84 can be submerged in the water 81 in the reservoir 80. The spraying unit 79 includes a pump 85 which has an input 86 and an output 87. A top end 107 of the intake tube 83 is fluidly coupled to the input 86 thereby enabling the pump 85 to urge the water 81 inwardly through the input 86 and outwardly through the output 87 when the pump 85 is turned on. Additionally, the pump 85 may comprise an electric fluid pump or the like. The spraying unit 79 includes an exhaust tube 88 which has a lower end 89 that is fluidly coupled to the output 87 of the pump 85 to receive the water 81 that is pumped by the pump 85. An upper end 90 of the exhaust tube 88 is fluidly coupled to an inlet 91 of the spray nozzle 82 to enable the spray nozzle 82 to receive the water 81 that is pumped by the pump 85. An outlet 92 of the spray nozzle 82 is directed toward the top end 67 of the roller housing 66 to direct the water 81 into the top end 67 of the roller housing 66 when the pump 85 is turned on.

A control processor 93 is provided and the control processor 93 is positioned in the housing 12. The control processor 93 is electrically coupled to each of the wrapper motor 45 and the grinding motor 58 and the pivoting motor 68 and the roller motor 72 and the pump 85. Additionally, the control processor 93 is electrically coupled to each of the wrapper sensor 48 and the grinding sensor 60 and the roller sensor 78 and the cigar sensor 47. The control processor 93 includes an electronic timer 94 and the control processor 93 receives a grinding input and a cigar input and a wrapper input and a roller input. The electronic timer 94 is actuated to countdown an operation duration of time when the control processor 93 receives the roller input and the wrapper motor 45 is turned on when the control processor 93 receives the wrapper input. Additionally, the grinding motor 58 is turned on when the control processor 93 receives the grinding input, the roller motor 72 is turned on to rotate in the first direction when the control processor 93 receives the roller input and the pump 85 is turned on when the control processor 93 receives the roller input.

The pivoting motor 68 is turned on to rotate in the second direction when the roller motor 72 has rotated in the first direction a predetermined duration of time which is sufficient to roll the cannabis cigarette commonly referred to as a blunt 15. Furthermore, the roller motor 72 is turned on to rotate in the second direction when the pivoting motor 68 is turned on the rotate in the second direction. In this way the roller unit 63 is enabled to eject the cannabis cigarette commonly referred to as a blunt 15 onto the dispensing ramp 61 for dispensing the cannabis cigarette commonly referred to as a blunt 15 through the output opening 25 in the front wall 24 of the housing 12. Each of the wrapper motor 45 and the grinding motor 58 and the roller motor 72 and the pump 85 is turned off when the electronic timer 94 counts down the operation duration of time. Additionally, the pivoting motor 68 is actuated to rotate in the first direction when the electronic timer 94 counts down the operation duration of time. The operation duration of time may be a duration of time ranging between approximately 20.0 seconds and 60.0 seconds or other duration of time that is sufficient to allow for the entire process of producing the cannabis cigarette commonly referred to as a blunt 15 to be performed.

A power supply 95 is integrated into the housing 12 and the power supply 95 is electrically coupled to the control processor 93. The power supply 95 comprises a power cord 96 which is coupled to and extends away from the back wall 23 of the housing 12 and the power cord 96 is electrically coupled to the control processor 93. The power cord 96 has a male plug 97 that is electrically coupled to a distal end 98 of the power cord 96 thereby enabling the male plug 97 to be plugged into a power source 99 comprising a female electrical outlet 100. The power supply 95 includes a rechargeable battery 101 which is positioned in a battery compartment 102 in the housing 12 and the rechargeable battery 101 is electrically coupled to the control processor 93. The control processor 93 receives electrical power from the rechargeable battery 101 when the power cord 96 is not plugged into the power source 99.

The power supply 95 includes a charge port 103 which is recessed into the back wall 23 of the housing 12 to insertably receive a charge cord 104. The charge port 103 is electrically coupled to the control processor 93 for charging the rechargeable battery 101. Additionally, the charge port 103 may comprise a universal serial bus port or other type of charge port that is commonly associated with rechargeable electronic devices. The power supply 95 includes a power switch 105 which is movably integrated into the front wall 24 of the housing 12 and the power switch 105 is electrically coupled to the control processor 93. The control processor 93 is turned on when the power switch 105 is moved into an on position and the control processor 93 is turned off when the power switch 105 is moved into an off position.

The power supply 95 includes a light 106 that is integrated into the front wall 24 of the housing 12 to emit light outwardly from the front wall 24 and the light 106 is electrically coupled to the control processor 93. The light 106 is turned on when the control processor 93 is turned on to produce a perceptible alert that the control processor 93 is turned on. Conversely, the light 106 is turned off when the control processor 93 is turned off to produce a perceptible alert than the control processor 93 is turned off. The light 106 may comprise a light emitting diode or other type of electronic light emitter.

In use, the cannabis flower 19 is dropped into the cannabis inlet 18 in the housing 12 and the grinding unit 49 is actuated to grind the cannabis flower 19 into the granular material 51 for subsequent deposit into the roller unit 63. Either the tobacco rolling sheet 14 is inserted into the wrapper inlet 13 or the cigar 17 is inserted into the cigar hole 16, depending upon which is available to the user 65. The slicing unit 31 longitudinally slices the cigar 17 to enable the tobacco wrapper 33 or the cigar 17 to be removed from the cigar 17 and subsequently transported into the wrapper chute 29. Either the tobacco rolling sheet 14 or the tobacco wrapper of the cigar 33 is deposited into the roller unit 63 and the roller unit 63 is turned on the roll the cannabis cigarette commonly referred to as a blunt 15. The roller unit 63 subsequently ejects the cannabis cigarette commonly referred to as a blunt 15 outwardly through the output opening 25 in the housing 12. In this way the cannabis cigarette commonly referred to as a blunt 15 is automatically rolled and dispensed for the smoking pleasure of the user 65.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cannabis cigarette rolling device for rolling a cannabis cigarette with a tobacco wrapper of a cigar thereby producing what is commonly referred to as a blunt, said device comprising:

a housing having a wrapper inlet extending into an interior of said housing wherein said wrapper inlet is configured to insertably receive a tobacco rolling sheet, said housing having a cigar hole extending into said interior of said housing wherein said cigar hole is configured to insertably receive a cigar, said housing having a cannabis inlet extending into said interior of said housing wherein said cannabis inlet is configured to insertably receive cannabis flower;

a slicing unit being positioned within said housing, said slicing unit being aligned with said cigar hole wherein said slicing unit is configured to receive the cigar when the cigar is inserted into said cigar hole, said slicing unit including a blade which is aligned with said cigar hole wherein said blade is configured to slice the cigar when the cigar is urged downwardly into said cigar hole thereby enabling a tobacco wrapper of the cigar to be removed from the cigar and enabling ground tobacco in the cigar to be removed from the cigar, said slicing unit being in communication with said wrapper inlet wherein said wrapper inlet is configured to receive the tobacco wrapper from said slicing unit;

a grinding unit being positioned within said housing, said grinding unit being aligned with said cannabis inlet wherein said grinding unit is configured to receive the cannabis flower that is inserted into said cannabis inlet, said grinding unit having a pair of rotating grinding disks which each rotate in opposing directions with respect to each other when said grinding unit is turned on wherein said grinding unit is configured to grind the cannabis flower into a granular material;

a roller unit being pivotally mounted in said housing, said roller unit being positioned beneath said wrapper inlet wherein said roller unit is configured to receive the tobacco rolling sheet when the tobacco rolling sheet is inserted into said wrapper inlet or the tobacco wrapper of the cigar when the cigar is inserted into said slicing unit, said roller unit being positioned adjacent to said grinding unit wherein said roller unit is configured to receive the granular material produced from the cannabis flower by said grinding unit, said roller unit being pivoted into a first position having an input of said roller unit being directed toward said wrapper inlet and said grinding unit, said roller unit being actuated into a rolling condition when said roller unit is in said first position wherein said roller unit is configured to roll either the tobacco rolling sheet or the tobacco wrapper of the cigar around the granular material thereby enabling said roller unit to produce a cannabis cigarette commonly referred to as a blunt, said roller unit being pivoted into a second position when said roller unit is actuated into said rolling condition having said roller unit being angled downwardly thereby facilitating said roller unit to be in communication with said output opening in said front wall of said housing wherein said roller unit is configured to deposit the cannabis cigarette commonly referred to as a blunt into said output opening thereby enabling a user to retrieve the cannabis cigarette commonly referred to as a blunt for smoking; and a spraying unit being positioned in said housing, said spraying unit including a reservoir wherein said reservoir is configured to contain water, said spraying unit having a spray nozzle being directed toward said roller unit, said spray nozzle being in fluid communication with said reservoir wherein said spray nozzle is configured to spray the water onto either the tobacco rolling sheet or the tobacco wrapper of the cigar when the tobacco rolling sheet or the tobacco wrapper of the cigar enters said roller unit thereby facilitating the tobacco rolling sheet or the tobacco wrapper of the cigar to be adhered to itself when the tobacco rolling sheet or the tobacco wrapper is rolled around the granular material produced by said grinding unit to form the cannabis cigarette commonly referred to as a blunt.

2. The device according to claim 1, wherein:

said wrapper inlet extends through a top wall of said housing;

said wrapper inlet is elongated along a line extending between a first lateral wall and a second lateral wall of said housing;

said wrapper inlet is positioned closer to a back wall of said housing than a front wall of said housing;

said cigar hole extends through said top wall of said housing;

said cigar hole is positioned closer to said second lateral wall of said housing than said first lateral wall of said housing;

said cigar hole is positioned between said wrapper inlet and said front wall of said housing;

said cannabis inlet extends through said top wall of said housing;

said cannabis inlet is positioned closer to said first lateral wall of said housing than said second lateral wall of said housing;

said cannabis inlet is positioned between said wrapper inlet and said front wall of said housing;

said housing has an output opening extending through said front wall of said housing into said interior of said housing;

said output opening is elongated to extend substantially between said first lateral wall and said second lateral wall of said housing;

said output opening is positioned closer to a bottom wall of said housing than said top wall of said housing;

said output opening is centrally positioned between said first lateral wall and said second lateral wall;

said housing has a cannabis drawer being slidably integrated into said second lateral wall of said housing;

said cannabis drawer is positioned between said tobacco drawer and said bottom wall.

3. The device according to claim 1, wherein:

said wrapper inlet includes a wrapper chute being coupled to and extending downwardly from a top wall of said housing such that said wrapper chute extends into said interior of said housing wherein said wrapper chute is configured to insertably receive the tobacco rolling sheet when the tobacco rolling sheet is inserted through said wrapper inlet; and said wrapper chute has an entry extending laterally through said wrapper chute.

4. The device according to claim 1, wherein:

said housing has a first lateral wall and a second lateral wall;

said housing has a tobacco drawer being slidably integrated into said second lateral wall of said housing;

said tobacco drawer is centrally positioned between said top wall and said bottom wall of said housing;

said slicing unit comprises a slicing cylinder being positioned within said housing;

said slicing cylinder has an upper end and a lower end and an outer wall extending between said upper end and said lower end;

said slicing cylinder has a wrapper slot extending through said outer wall;

said wrapper slot is elongated to extend substantially between said upper end and said lower end;

said wrapper slot is aligned with and is directed toward said entry in said wrapper chute;

each of said upper end and said lower end is open;

said upper end is aligned with said cigar hole having said slicing cylinder being vertically oriented in said housing wherein said upper end is configured to insertably receive the cigar when the cigar is inserted into said cigar hole;

said blade has a coupled end being attached to an inside surface of said outer wall of said slicing cylinder such that said blade extends into an interior of said slicing cylinder;

said blade is positioned adjacent to said upper end of said slicing cylinder;

said blade has a cutting edge angling downwardly between said coupled end and a free end of said blade such that said blade tapers to a point at said free end;

said cutting edge is sharpened wherein said cutting edge is configured to cut through the tobacco wrapper of the cigar when the cigar is urged downwardly through said cigar hole; and said lower end is aligned with said tobacco drawer wherein said lower end is configured to direct the tobacco in the cigar downwardly into said tobacco drawer when the cigar is sliced thereby enabling the tobacco to be collected in said tobacco drawer.

5. The device according to claim 4, wherein:

said slicing unit includes a wrapper roller being rotatably disposed in said outer wall of said slicing cylinder wherein said wrapper roller is configured to frictionally engage the tobacco wrapper when the cigar is sliced;

said wrapper roller is rotatable about an axis extending between said upper end and said lower end of said slicing cylinder;

said wrapper roller is aligned with said wrapper slot in said outer wall of said slicing cylinder wherein said wrapper roller is configured to urge the tobacco wrapper outwardly through said wrapper slot and inwardly through said entry in said wrapper chute;

said slicing unit includes a wrapper motor being disposed in said outer wall of said slicing cylinder;

said wrapper motor has an output shaft being in mechanical communication with said wrapper roller; and said wrapper motor rotates said output shaft in a first direction when said wrapper motor is turned on thereby facilitating said output shaft to rotate said wrapper roller about said axis extending between said upper end and said lower end of said slicing cylinder.

6. The device according to claim 1, wherein:

said grinding unit includes a grinding hopper having a central container being positioned between and being in fluid communication with each of an entry funnel and an exit funnel;

said entry funnel is in fluid communication with said cannabis inlet wherein said entry funnel is configured to direct the cannabis flower into said central container when the cannabis flower is inserted into said cannabis inlet;

each of said pair of rotating grinding disks is rotatably disposed within said central container;

each of said pair of rotating grinding disks is rotatable about an axis extending between said entry funnel and said exit funnel;

said pair of rotating grinding disks being positioned closer to said entry funnel than said exit funnel wherein said pair of rotating grinding disks is configured to direct the granular material produced from the cannabis flower downwardly into said exit funnel;

said exit funnel angles laterally away from said central container; and each of said pair of rotating grinding disks has a series of teeth being disposed on an outer surface of a respective rotating grinding disk wherein said series of teeth on each of said outer surface of each of said pair of rotating grinding disks is configured to chop the cannabis flower into the granular material.

7. The device according to claim 6, wherein:

said grinding unit includes a grinding motor being positioned within said central container;

said grinding motor has an output shaft being in mechanical communication with each of said pair of rotating grinding disks; and said grinding motor rotates said output shaft of said grinding motor in a first direction when said grinding motor is turned on thereby enabling said output shaft of said grinding motor to rotate each of said pair of rotating grinding disks.

8. The device according to claim 1, wherein:

said housing has a front wall;

said housing has an output opening extending through said front wall;

said device includes a dispensing ramp being attached to and angling upwardly from an inside surface of said front wall of said housing such that said dispensing ramp is positioned inside of said housing;

said dispensing ramp is aligned with said output opening in said front wall of said housing;

said roller unit includes a roller housing having a top end being open;

said roller unit includes a pivoting motor being integrated into said roller housing at a point aligned with an intersection between a rear wall of said roller housing and a lower wall of said roller housing;

said pivoting motor pivots said roller housing into a first position when said pivoting motor is actuated to rotate in a first direction having said top end of said roller housing being directed toward said wrapper chute wherein said top end of said roller housing is configured to insertably receive either the tobacco rolling sheet or the tobacco wrapper of the cigar; and said pivoting motor pivots said roller housing into a second position when said pivoting motor is actuated to rotate in a second direction having said roller housing angling downwardly toward said dispensing ramp.

9. The device according to claim 8, wherein:

said roller unit includes a first roller being rotatably disposed in said roller housing;

said first roller is rotatable about an axis being oriented parallel to said top end of said roller housing;

said first roller is aligned with an intersection between said top end of said roller housing and said rear wall of said roller housing;

said roller unit includes a roller motor being disposed within said roller housing;

said roller motor rotates in a first direction or a second direction when said roller motor is turned on;

said roller unit includes a roller drive being mechanically coupled to said roller motor;

said roller drive is driven in a first direction when said roller motor rotates in said first direction;

said roller drive is driven in a second direction when said roller motor rotates in said second direction;

said roller drive is pivoted to travel toward said first roller when said roller motor rotates in said first direction; and said roller drive is pivoted to travel away from said first roller when said roller motor rotates in said second direction.

10. The device according to claim 9, wherein:

said roller unit includes a second roller being rotatably attached to said roller drive;

said second roller is rotated in a first direction when said roller motor rotates in said first direction;

said second roller is rotated in a second direction when said roller motor rotates in said second direction;

said second roller abuts said first roller when said roller drive is pivoted to travel toward said first roller thereby enabling said second roller to rotate said first roller when said roller motor rotates in said first direction; and said second roller is displaced from said first roller when said roller drive is pivoted to travel away from said first roller.

11. The device according to claim 10, wherein:

said roller unit includes a belt extending around each of said first roller and said second roller;

said belt travels in a first direction when said second roller abuts and rotates said first roller;

said belt has a length that is sufficient to enable to said belt to form an open loop extending downwardly from said first roller and said second roller when said second roller is displaced from said first roller wherein said open loop is configured to capture the granular material produced by said grinding unit; and said belt forms a closed loop when said second roller abuts said first roller wherein said belt is configured to urge either the tobacco rolling sheet or the tobacco wrapper to wrap around the granular material thereby forming the cannabis cigarette commonly referred to as a blunt.

12. The device according to claim 1, wherein:

said roller unit includes a roller housing having a top end;

said spraying unit includes an intake tube extending into said reservoir such that a bottom end of said intake tube is positioned within said reservoir wherein said bottom end is configured to be submerged in the water in said reservoir;

said spraying unit includes a pump having an input and an output;

a top end of said intake tube is fluidly coupled to said input wherein said pump is configured to urge the water inwardly through said input and outwardly through said output when said pump is turned on;

said spraying unit includes an exhaust tube having a lower end being fluidly coupled to said output of said pump wherein said exhaust tube is configured to receive the water being pumped by said pump;

an upper end of said exhaust tube is fluidly coupled to an inlet of said spray nozzle wherein said spray nozzle is configured to receive the water being pumped by said pump; and an outlet of said spray nozzle is directed toward said top end of said roller housing wherein said outlet of said spray nozzle is configured to direct the water into said top end of said roller housing when said pump is turned on.

13. The device according to claim 1, wherein:

said slicing unit includes a slicing cylinder;

said device includes a cigar sensor being positioned in said slicing cylinder wherein said cigar sensor is configured to sense when the cigar is urged into said slicing cylinder;

said device includes a wrapper chute;

said device includes a wrapper sensor being positioned in said wrapper chute wherein said wrapper sensor is configured to sense either the tobacco rolling sheet or the tobacco wrapper of the cigar in said wrapper chute;

said grinding unit includes an entry funnel;

said device includes a grinding sensor being positioned in said entry funnel wherein said grinding sensor is configured to sense the cannabis flower entering said entry funnel;

said roller unit includes a roller housing having a top end;

said device includes a roller sensor being positioned in said roller housing wherein said roller sensor is configured to sense the granular material produced by said grinding unit entering said top end of said roller housing;

said device includes a wrapper motor and a grinding motor and a pivoting motor and a roller motor and a pump; and said pivoting motor rotating in a first direction or a second direction when said pivoting motor is turned on.

14. The device according to claim 13, wherein said device includes a control processor being positioned in said housing;

said control processor is electrically coupled to each of said wrapper motor and said grinding motor and said pivoting motor and said roller motor and said pump;

said control processor is electrically coupled to each of said wrapper sensor and said grinding sensor and said roller sensor and said cigar sensor;

said control processor includes an electronic timer;

said control processor receives a grinding input and a cigar input and a wrapper input and a roller input;

said electronic timer is actuated to countdown an operation duration of time when said control processor receives said roller input;

said wrapper motor is turned on when said control processor receives said wrapper input;

said grinding motor is turned on when said control processor receives said grinding input;

said roller motor is turned on to rotate in a first direction when said control processor receives said roller input;

said pump is turned on when said control processor receives said roller input; and said pivoting motor is turned on to rotate in said second direction when said roller motor has rotated in a first direction for a predetermined duration of time which is sufficient to roll the cannabis cigarette commonly referred to as a blunt.

15. The device according to claim 14, wherein:

said housing has a front wall;

said housing has an output opening extending through said front wall;

said device includes a dispensing ramp being attached to and angling upwardly from an inside surface of said front wall of said housing such that said dispensing ramp is positioned inside of said housing;

said roller motor is turned on to rotate in a second direction when said pivoting motor is turned on the rotate in said second direction wherein said roller unit is configured to eject the cannabis cigarette commonly referred to as a blunt onto said dispensing ramp for dispensing the cannabis cigarette commonly referred to as a blunt through said output opening in said front wall of said housing;

each of said wrapper motor and said grinding motor and said roller motor and said pump is turned off when said electronic timer counts down said operation duration of time; and said pivoting motor is actuated to rotate in said first direction when said electronic timer counts down said operation duration of time.

16. The device according to claim 1, wherein:

said device includes a control processor;

said device includes a power supply being integrated into said housing;

said power supply is electrically coupled to said control processor;

said power supply includes:

a power cord being coupled to and extending away from a back wall of said housing;

said power cord is electrically coupled to said control processor; and said power cord has a male plug being electrically coupled to a distal end of said power cord thereby enabling said male plug to be plugged into a power source comprising a female electrical outlet;

said power supply includes:

a rechargeable battery being positioned in a battery compartment in said housing;

said rechargeable battery is electrically coupled to said control processor; and said control processor receives electrical power from said rechargeable battery when said power cord is not plugged into said power source;

said power supply includes:

a charge port being recessed into said back wall of said housing wherein said charge port is configured to insertably receive a charge cord; and said charge port is electrically coupled to said control processor for charging said rechargeable battery;

said power supply includes:

a power switch being movably integrated into a front wall of said housing;

said power switch is electrically coupled to said control processor;

said control processor is turned on when said power switch is moved into an on position; and said control processor is turned off when said power switch is moved into an off position;

said power supply includes:

a light being integrated into said front wall of said housing wherein said light is configured to emit light outwardly from said front wall;

said light is electrically coupled to said control processor;

said light is turned on when said control processor is turned on wherein said light is configured to produce a perceptible alert that said control processor is turned on; and said light is turned off when said control processor is turned off wherein said light is configured to produce a perceptible alert than said control processor is turned off.

17. A cannabis cigarette rolling device for rolling a cannabis cigarette with a tobacco wrapper of a cigar thereby producing what is commonly referred to as a blunt, said device comprising:

a housing having a wrapper inlet extending into an interior of said housing wherein said wrapper inlet is configured to insertably receive a tobacco rolling sheet, said housing having a cigar hole extending into said interior of said housing wherein said cigar hole is configured to insertably receive a cigar, said housing having a cannabis inlet extending into said interior of said housing wherein said cannabis inlet is configured to insertably receive cannabis flower, said wrapper inlet extending through a top wall of said housing, said wrapper inlet being elongated along a line extending between a first lateral wall and a second lateral wall of said housing, said wrapper inlet being positioned closer to a back wall of said housing than a front wall of said housing, said cigar hole extending through said top wall of said housing, said cigar hole being positioned closer to said second lateral wall of said housing than said first lateral wall of said housing, said cigar hole being positioned between said wrapper inlet and said front wall of said housing, said cannabis inlet extending through said top wall of said housing, said cannabis inlet being positioned closer to said first lateral wall of said housing than said second lateral wall of said housing, said cannabis inlet being positioned between said wrapper inlet and said front wall of said housing, said housing having an output opening extending through said front wall of said housing into said interior of said housing, said output opening being elongated to extend substantially between said first lateral wall and said second lateral wall of said housing, said output opening being positioned closer to a bottom wall of said housing than said top wall of said housing, said output opening being centrally positioned between said first lateral wall and said second lateral wall, said housing having a tobacco drawer being slidably integrated into said second lateral wall of said housing, said housing having a cannabis drawer being slidably integrated into said second lateral wall of said housing, said tobacco drawer being centrally positioned between said top wall and said bottom wall of said housing, said cannabis drawer being positioned between said tobacco drawer and said bottom wall;

wherein said wrapper inlet includes a wrapper chute being coupled to and extending downwardly from said top wall of said housing such that said wrapper chute extends into said interior of said housing wherein said wrapper chute is configured to insertably receive the tobacco rolling sheet when the tobacco rolling sheet is inserted through said wrapper inlet, said wrapper chute having an entry extending laterally through said wrapper chute;

a slicing unit being positioned within said housing, said slicing unit being aligned with said cigar hole wherein said slicing unit is configured to receive the cigar when the cigar is inserted into said cigar hole, said slicing unit including a blade which is aligned with said cigar hole wherein said blade is configured to slice the cigar when the cigar is urged downwardly into said cigar hole thereby enabling a tobacco wrapper of the cigar to be removed from the cigar and enabling ground tobacco in the cigar to be removed from the cigar, said slicing unit being in communication with said wrapper inlet wherein said wrapper inlet is configured to receive the tobacco wrapper from said slicing unit, said slicing unit comprising:

a slicing cylinder being positioned within said housing, said slicing cylinder having an upper end and a lower end and an outer wall extending between said upper end and said lower end, said slicing cylinder having a wrapper slot extending through said outer wall, said wrapper slot being elongated to extend substantially between said upper end and said lower end, said wrapper slot being aligned with and being directed toward said entry in said wrapper chute, each of said upper end and said lower end being open, said upper end being aligned with said cigar hole having said slicing cylinder being vertically oriented in said housing wherein said upper end is configured to insertably receive the cigar when the cigar is inserted into said cigar hole, said blade having a coupled end being attached to an inside surface of said outer wall of said slicing cylinder such that said blade extends into an interior of said slicing cylinder, said blade being positioned adjacent to said upper end of said slicing cylinder, said blade having a cutting edge angling downwardly between said coupled end and a free end of said blade such that said blade tapers to a point at said free end, said cutting edge being sharpened wherein said cutting edge is configured to cut through the tobacco wrapper of the cigar when the cigar is urged downwardly through said cigar hole, said lower end being aligned with said tobacco drawer wherein said lower end is configured to direct the tobacco in the cigar downwardly into said tobacco drawer when the cigar is sliced thereby enabling the tobacco to be collected in said tobacco drawer;

a wrapper roller being rotatably disposed in said outer wall of said slicing cylinder wherein said wrapper roller is configured to frictionally engage the tobacco wrapper when the cigar is sliced, said wrapper roller being rotatable about an axis extending between said upper end and said lower end of said slicing cylinder, said wrapper roller being aligned with said wrapper slot in said outer wall of said slicing cylinder wherein said wrapper roller is configured to urge the tobacco wrapper outwardly through said wrapper slot and inwardly through said entry in said wrapper chute; and a wrapper motor being disposed in said outer wall of said slicing cylinder, said wrapper motor having an output shaft being in mechanical communication with said wrapper roller, said wrapper motor rotating said output shaft in a first direction when said wrapper motor is turned on thereby facilitating said output shaft to rotate said wrapper roller about said axis extending between said upper end and said lower end of said slicing cylinder;

a cigar sensor being positioned in said slicing cylinder wherein said cigar sensor is configured to sense when the cigar is urged into said slicing cylinder;

a wrapper sensor being positioned in said wrapper chute wherein said wrapper sensor is configured to sense either the tobacco rolling sheet or the tobacco wrapper of the cigar in said wrapper chute;

a grinding unit being positioned within said housing, said grinding unit being aligned with said cannabis inlet wherein said grinding unit is configured to receive the cannabis flower that is inserted into said cannabis inlet, said grinding unit having a pair of rotating grinding disks which each rotate in opposing directions with respect to each other when said grinding unit is turned on wherein said grinding unit is configured to grind the cannabis flower into a granular material, said grinding unit comprising:

a grinding hopper having a central container being positioned between and being in fluid communication with each of an entry funnel and an exit funnel, said entry funnel being in fluid communication with said cannabis inlet wherein said entry funnel is configured to direct the cannabis flower into said central container when the cannabis flower is inserted into said cannabis inlet, each of said pair of rotating grinding disks being rotatably disposed within said central container, each of said pair of rotating grinding disks being rotatable about an axis extending between said entry funnel and said exit funnel, said pair of rotating grinding disks being positioned closer to said entry funnel than said exit funnel wherein said pair of rotating grinding disks is configured to direct the granular material produced from the cannabis flower downwardly into said exit funnel, said exit funnel angling laterally away from said central container, each of said pair of rotating grinding disks having a series of teeth being disposed on an outer surface of a respective rotating grinding disk wherein said series of teeth on each of said outer surface of each of said pair of rotating grinding disks is configured to chop the cannabis flower into the granular material; and a grinding motor being positioned within said central container, said grinding motor having an output shaft being in mechanical communication with each of said pair of rotating grinding disks, said grinding motor rotating said output shaft of said grinding motor in a first direction when said grinding motor is turned on thereby enabling said output shaft of said grinding motor to rotate each of said pair of rotating grinding disks;

a grinding sensor being positioned in said entry funnel wherein said grinding sensor is configured to sense the cannabis flower entering said entry funnel;

a dispensing ramp being attached to and angling upwardly from an inside surface of said front wall of said housing such that said dispensing ramp is positioned inside of said housing, said dispensing ramp being aligned with said output opening in said front wall of said housing;

a roller unit being pivotally mounted in said housing, said roller unit being positioned beneath said wrapper inlet wherein said roller unit is configured to receive the tobacco rolling sheet when the tobacco rolling sheet is inserted into said wrapper inlet or the tobacco wrapper of the cigar when the cigar is inserted into said slicing unit, said roller unit being positioned adjacent to said grinding unit wherein said roller unit is configured to receive the granular material produced from the cannabis flower by said grinding unit, said roller unit being pivoted into a first position having an input of said roller unit being directed toward said wrapper inlet and said grinding unit, said roller unit being actuated into a rolling condition when said roller unit is in said first position wherein said roller unit is configured to roll either the tobacco rolling sheet or the tobacco wrapper of the cigar around the granular material thereby enabling said roller unit to produce a cannabis cigarette commonly referred to as a blunt, said roller unit being pivoted into a second position when said roller unit is actuated into said rolling condition having said roller unit being angled downwardly thereby facilitating said roller unit to be in communication with said output opening in said front wall of said housing wherein said roller unit is configured to deposit the cannabis cigarette commonly referred to as a blunt into said output opening thereby enabling a user to retrieve the cannabis cigarette commonly referred to as a blunt for smoking, said roller unit comprising:

a roller housing having a top end being open;

a pivoting motor being integrated into said roller housing at a point aligned with an intersection between a rear wall of said roller housing and a lower wall of said roller housing, said pivoting motor pivoting said roller housing into a first position when said pivoting motor is actuated to rotate in a first direction having said top end of said roller housing being directed toward said wrapper chute wherein said top end of said roller housing is configured to insertably receive either the tobacco rolling sheet or the tobacco wrapper of the cigar, said pivoting motor pivoting said roller housing into a second position when said pivoting motor is actuated to rotate in a second direction having said roller housing angling downwardly toward said dispensing ramp;

a first roller being rotatably disposed in said roller housing, said first roller being rotatable about an axis being oriented parallel to said top end of said roller housing, said first roller being aligned with an intersection between said top end of said roller housing and said rear wall of said roller housing;

a roller motor being disposed within said roller housing, said roller motor rotating in a first direction or a second direction when said roller motor is turned on;

a roller drive being mechanically coupled to said roller motor, said roller drive being driven in a first direction when said roller motor rotates in said first direction, said roller drive being driven in a second direction when said roller motor rotates in said second direction, said roller drive being pivoted to travel toward said first roller when said roller motor rotates in said first direction, said roller drive being pivoted to travel away from said first roller when said roller motor rotates in said second direction;

a second roller being rotatably attached to said roller drive, said second roller being rotated in a first direction when said roller motor rotates in said first direction, said second roller being rotated in a second direction when said roller motor rotates in said second direction, said second roller abutting said first roller when said roller drive is pivoted to travel toward said first roller thereby enabling said second roller to rotate said first roller when said roller motor rotates in said first direction, said second roller being displaced from said first roller when said roller drive is pivoted to travel away from said first roller; and a belt extending around each of said first roller and said second roller, said belt travelling in a first direction when said second roller abuts and rotates said first roller, said belt having a length being sufficient to enable to said belt to form an open loop extending downwardly from said first roller and said second roller when said second roller is displaced from said first roller wherein said open loop is configured to capture the granular material produced by said grinding unit, said belt forming a closed loop when said second roller abuts said first roller wherein said belt is configured to urge either the tobacco rolling sheet or the tobacco wrapper to wrap around the granular material thereby forming the cannabis cigarette commonly referred to as a blunt;

a roller sensor being positioned in said roller housing wherein said roller sensor is configured to sense the granular material produced by said grinding unit entering said top end of said roller housing;

a spraying unit being positioned in said housing, said spraying unit including a reservoir wherein said reservoir is configured to contain water, said spraying unit having a spray nozzle being directed toward said roller unit, said spray nozzle being in fluid communication with said reservoir wherein said spray nozzle is configured to spray the water onto either the tobacco rolling sheet or the tobacco wrapper of the cigar when the tobacco rolling sheet or the tobacco wrapper of the cigar enters said roller unit thereby facilitating the tobacco rolling sheet or the tobacco wrapper of the cigar to be adhered to itself when the tobacco rolling sheet or the tobacco wrapper is rolled around the granular material produced by said grinding unit to form the cannabis cigarette commonly referred to as a blunt, said spraying unit including:

an intake tube extending into said reservoir such that a bottom end of said intake tube is positioned within said reservoir wherein said bottom end is configured to be submerged in the water in said reservoir;

a pump having an input and an output, a top end of said intake tube being fluidly coupled to said input wherein said pump is configured to urge the water inwardly through said input and outwardly through said output when said pump is turned on; and an exhaust tube having a lower end being fluidly coupled to said output of said pump wherein said exhaust tube is configured to receive the water being pumped by said pump, an upper end of said exhaust tube being fluidly coupled to an inlet of said spray nozzle wherein said spray nozzle is configured to receive the water being pumped by said pump, an outlet of said spray nozzle being directed toward said top end of said roller housing wherein said outlet of said spray nozzle is configured to direct the water into said top end of said roller housing when said pump is turned on;

a control processor being positioned in said housing, said control processor being electrically coupled to each of said wrapper motor and said grinding motor and said pivoting motor and said roller motor and said pump, said control processor being electrically coupled to each of said wrapper sensor and said grinding sensor and said roller sensor and said cigar sensor, said control processor including an electronic timer, said control processor receiving a grinding input and a cigar input and a wrapper input and a roller input, said electronic timer being actuated to countdown an operation duration of time when said control processor receives said roller input, said wrapper motor being turned on when said control processor receives said wrapper input, said grinding motor being turned on when said control processor receives said grinding input, said roller motor being turned on to rotate in said first direction when said control processor receives said roller input, said pump being turned on when said control processor receives said roller input, said pivoting motor being turned on to rotate in said second direction when said roller motor has rotated in said first direction a predetermined duration of time which is sufficient to roll the cannabis cigarette commonly referred to as a blunt, said roller motor being turned on to rotate in said second direction when said pivoting motor is turned on the rotate in said second direction wherein said roller unit is configured to eject the cannabis cigarette commonly referred to as a blunt onto said dispensing ramp for dispensing the cannabis cigarette commonly referred to as a blunt through said output opening in said front wall of said housing, each of said wrapper motor and said grinding motor and said roller motor and said pump being turned off when said electronic timer counts down said operation duration of time, said pivoting motor being actuated to rotate in said first direction when said electronic timer counts down said operation duration of time; and a power supply being integrated into said housing, said power supply being electrically coupled to said control processor, said power supply comprising:

a power cord being coupled to and extending away from said back wall of said housing, said power cord being electrically coupled to said control processor, said power cord having a male plug being electrically coupled to a distal end of said power cord thereby enabling said male plug to be plugged into a power source comprising a female electrical outlet;

a rechargeable battery being positioned in a battery compartment in said housing, said rechargeable battery being electrically coupled to said control processor, said control processor receiving electrical power from said rechargeable battery when said power cord is not plugged into said power source;

a charge port being recessed into said back wall of said housing wherein said charge port is configured to insertably receive a charge cord, said charge port being electrically coupled to said control processor for charging said rechargeable battery;

a power switch being movably integrated into said front wall of said housing, said power switch being electrically coupled to said control processor, said control processor being turned on when said power switch is moved into an on position, said control processor being turned off when said power switch is moved into an off position; and a light being integrated into said front wall of said housing wherein said light is configured to emit light outwardly from said front wall, said light being electrically coupled to said control processor, said light being turned on when said control processor is turned on wherein said light is configured to produce a perceptible alert that said control processor is turned on, said light being turned off when said control processor is turned off wherein said light is configured to produce a perceptible alert than said control processor is turned off.

* * * * *